United States Patent [19]

Mori et al.

[11] 4,365,388

[45] Dec. 28, 1982

[54] APPARATUS FOR AUTOMATICALLY CHANGING CANS OF A SPINNING MACHINE

[75] Inventors: Mitsuo Mori, Toyota; Yoshihisa Suzuki, Chiryu, both of Japan

[73] Assignee: Kabushiki Kaisha Toyoda Jidoshokki Seisakusho, Aichi, Japan

[21] Appl. No.: 184,177

[22] Filed: Sep. 4, 1980

[30] Foreign Application Priority Data

Sep. 10, 1979 [JP] Japan ..... 54/116585

[51] Int. Cl.[3] ..... B65H 54/80

[52] U.S. Cl. ..... 19/159 A

[58] Field of Search ..... 19/159 A; 57/281; 198/339, 742

[56] References Cited

U.S. PATENT DOCUMENTS

| | | | |
|---|---|---|---|
| 3,429,009 | 2/1969 | Goodner | 19/159 A |
| 3,808,641 | 5/1974 | Schneider et al. | 19/159 A |
| 4,042,093 | 8/1977 | Fujii et al. | 19/159 A |
| 4,292,712 | 10/1981 | Bonner | 19/159 A |

FOREIGN PATENT DOCUMENTS

| | | | |
|---|---|---|---|
| 43-6321 | 8/1968 | Japan | 19/159 A |
| 52-18928 | 12/1977 | Japan . | |
| 2041016 | 9/1980 | United Kingdom | 19/159 A |

*Primary Examiner*—Louis Rimrodt

*Attorney, Agent, or Firm*—Burgess, Ryan and Wayne

[57] ABSTRACT

An apparatus for automatically changing cans of a spinning machine, such as a drawing frame or a carding machine. The apparatus comprises: a movable support frame which can be reciprocated along the can transporting direction; and a plurality of can transporting arms which are substantially equidistantly arranged on the support frame and which can alternately be located at operating positions where the arms transport the cans and stand-by positions where the arms do not interfere with the cans, whereby, when the movable support frame is moved forward, the can transporting arms are maintained at the operating positions so as to transport the cans, and then, after the can transporting arms are returned to their stand-by positions from their operating positions, the support frame is moved backward. The apparatus is characterized in that it further comprises an arm height adjusting member by which individual heights of the can transporting arms in the operating positions where the arms are abutted with the cans are adjustable while the can transporting arms in the stand-by positions are almost at the same level as each other.

8 Claims, 15 Drawing Figures

APPARATUS FOR AUTOMATICALLY CHANGING CANS OF A SPINNING MACHINE

FIELD OF THE INVENTION

The present invention relates to an apparatus for automatically changing cans of a spinning machine, such as a drawing frame or a carding machine.

PRIOR ART OF THE INVENTION

Conventionally known is an apparatus for automatically changing cans which is disclosed in, for example, Japanese Patent Application Laid-open Specification No. 18928/1977 and in which traverse bars which are reciprocal along the cans transporting direction are moved forward so that full cans and empty cans are forwarded by a distance equal to the distance between two adjacent cans by means of a plurality of can transporting arms which are connected to the traverse bars and which are maintained in a single horizontal plane while they are at their operating positions. As a result, the full cans are discharged from can tables, and the empty cans located next to the discharged full cans are then transported onto the can tables. After the can transporting arms are turned to their vertically located stand-by positions so that they do not interfere with the cans, the can transporting arms are moved backward, and then they are returned to their horizontally located operating positions.

In the above-mentioned conventional apparatus for automatically changing cans, however, all of the can transporting arms are maintained in the same horizontal plane when the traverse bars are moved forward so as to discharge the cans, and accordingly, the full cans filled with fiber bundles, such as slivers, and having a high center of gravity, and the empty cans having a low center of gravity, cannot be abutted with the can transporting arms at their appropriate pushing positions. As a result, sometimes, cans may be inclined from the vertical position and cannot be transported stably.

Even if the size of the cans are the same, the coefficient of friction between the bottom of the empty can and the floor surface over which the empty can is slid may differ when the material, for example, plastic, iron plate or fiber, constituting the bottom of the can is varied. Accordingly, it is necessary to alter the height where the can transporting arm is abutted with the can in accordance with the material of the bottom of the empty can so that the can is always stably transported.

Especially, it should be noted that, when an empty can located at the second position from a head is transported onto the can table, the empty can must pass through a clearance located between the can table and the floor over which the can is slid, and that sometimes a small vertical step is formed between the can table and the floor. In the latter case, the empty can is stably transported only if the corresponding can transporting arm is set at a height lower than that of the remaining can transporting arms.

Furthermore, since spinning speeds have increased recently, the annular clearance formed between the upper edge of the can and the spinning head surface of the spinning machine must be small so that the spun fibers are prevented from being scattered from the can through the annular clearance due to centrifugal force. In this case, if the abutting height of the can transporting arm is inappropriate, the can may be inclined when it is pushed by the can transporting arm, and accordingly, the inclined can becomes stuck between the can table and the spinning head surface.

In addition, when the predetermined amount of a fiber bundle which is to be collected in a can is changed or when a can having a diameter different from a previous one is used, the height of the center of gravity of the can may be varied, and accordingly, the can transporting arm must be abutted with the can at an appropriate height in accordance with said change in the center of gravity.

SUMMARY OF THE INVENTION

An object of the present invention is to eliminate the disadvantages which are inherent in the prior art. More specifically, the object of the present invention is to provide an apparatus for automatically changing cans of a spinning machine in which the can transporting arm for discharging a full can and the can transporting arm for feeding an empty can are constructed in such a manner that their height can be adjusted, whereby the can transporting arms are abutted with the full can and the empty can at their appropriate heights so that the cans are stably transported.

In the present invention, the object is achieved by an apparatus for automatically changing cans of a spinning machine comprising a movable support frame which can be reciprocated along the can transporting direction, and a plurality of can transporting arms which are substantially equidistantly arranged on the support frame and which can alternately be located at operating positions where the arms transport the cans and stand-by positions where the arms do not interfere with the cans, whereby, when the support frame is moved forward, the can transporting arms are maintained at their operating positions so as to transport the cans, and then, after the can transporting arms are returned to their stand-by positions from their operating positions, the support frame is moved backward. The apparatus further comprises an arm height adjusting member by which the individual heights of the can transporting arms in their operating positions where the arms abut with the cans are adjustable while the transporting arms in their stand-by positions are almost at the same level as each other.

BRIEF DESCRIPTION OF THE DRAWINGS

Several embodiments which are constructed in accordance with the present invention will now be explained with reference to the accompanying drawings, wherein.

DETAILED DESCRIPTION OF THE INVENTION

Figure 1:
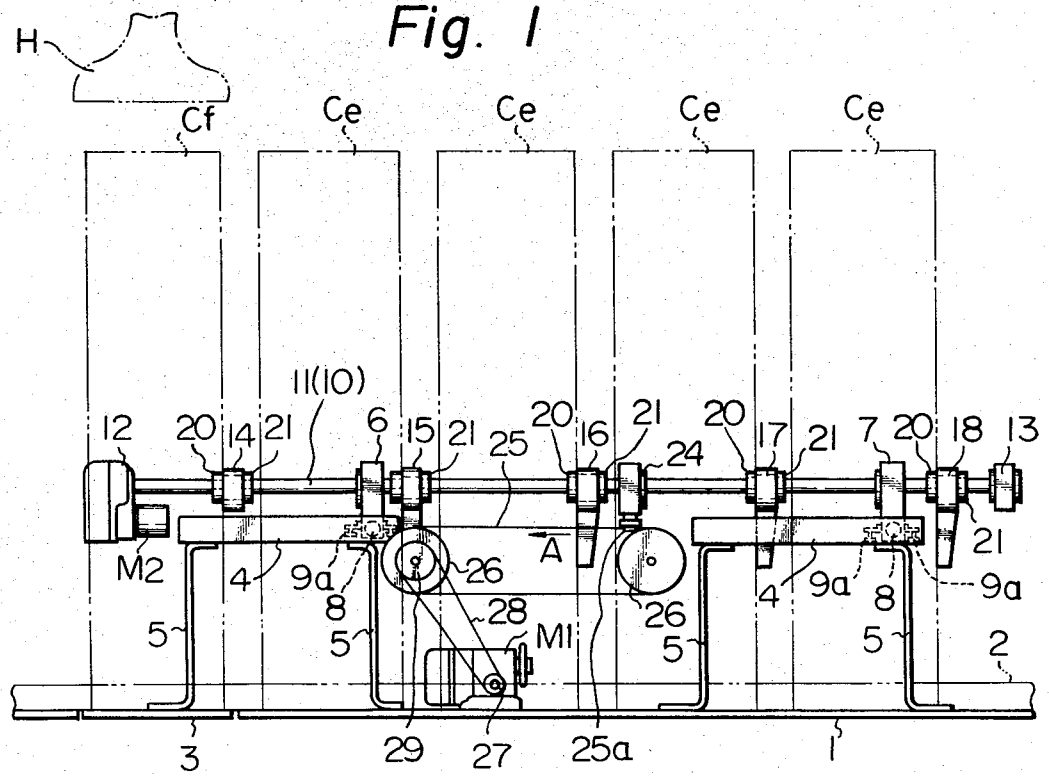
FIG. 1 is a side view of an embodiment of an apparatus for automatically changing cans according to the present invention.
Figure 3:
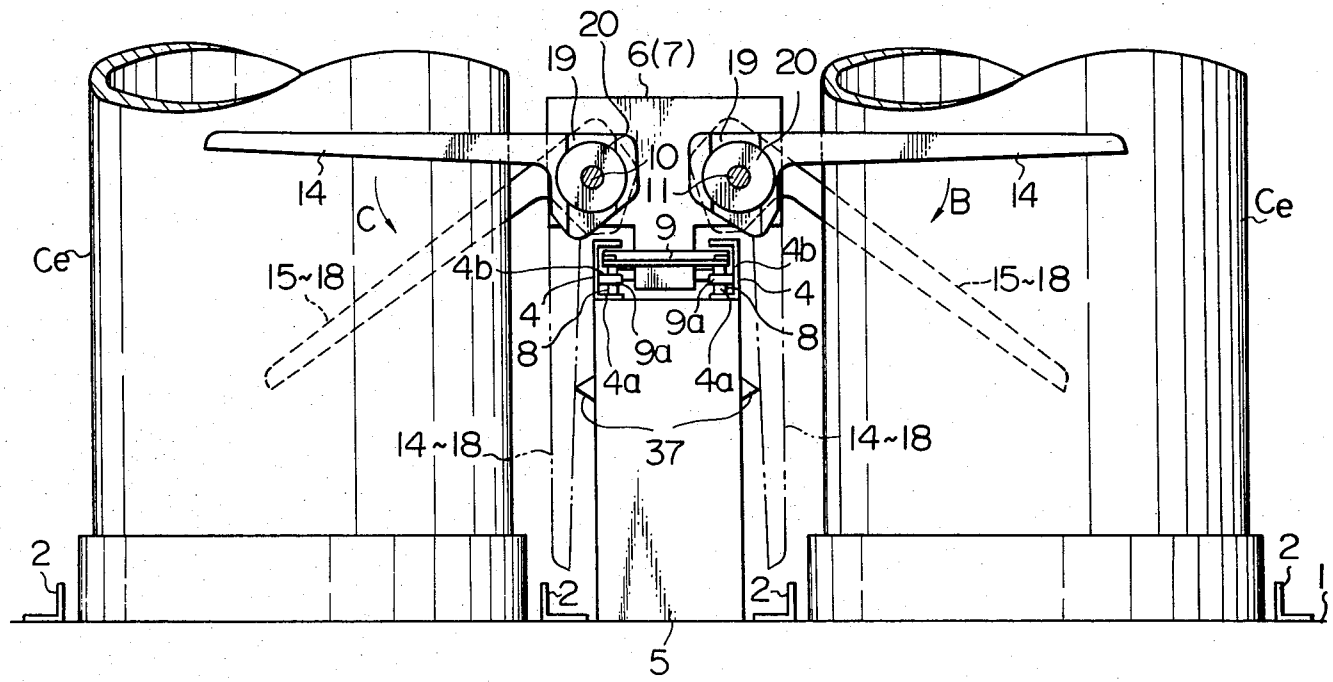
FIG. 3 is an enlarged elevational view of a pair of can transporting arms installed in the apparatus of FIG. 1.

Referring to FIG. 1, can guide plate 1 has can guide rails 2 mounted thereon (only one guide rail 2 is illustrated in FIG. 1). The can guide rails 2 have an L-shape cross section as illustrated in FIG. 3, and pairs of the rails 2 are secured to the top surface of the guide plate 1 so that vertical walls of rails 2 are parallel to each other. Referring to FIG. 1 again, a pair of turn tables 3 (only one of which is illustrated in FIG. 1) is rotatably disposed beneath a spinning head H of a spinning machine so that a can located at a spinning position can be rotated on a plane in which the upper surface of the guide plate 1 is included. The turn tables 3 serve as the can table of the present invention.

Figure 2:
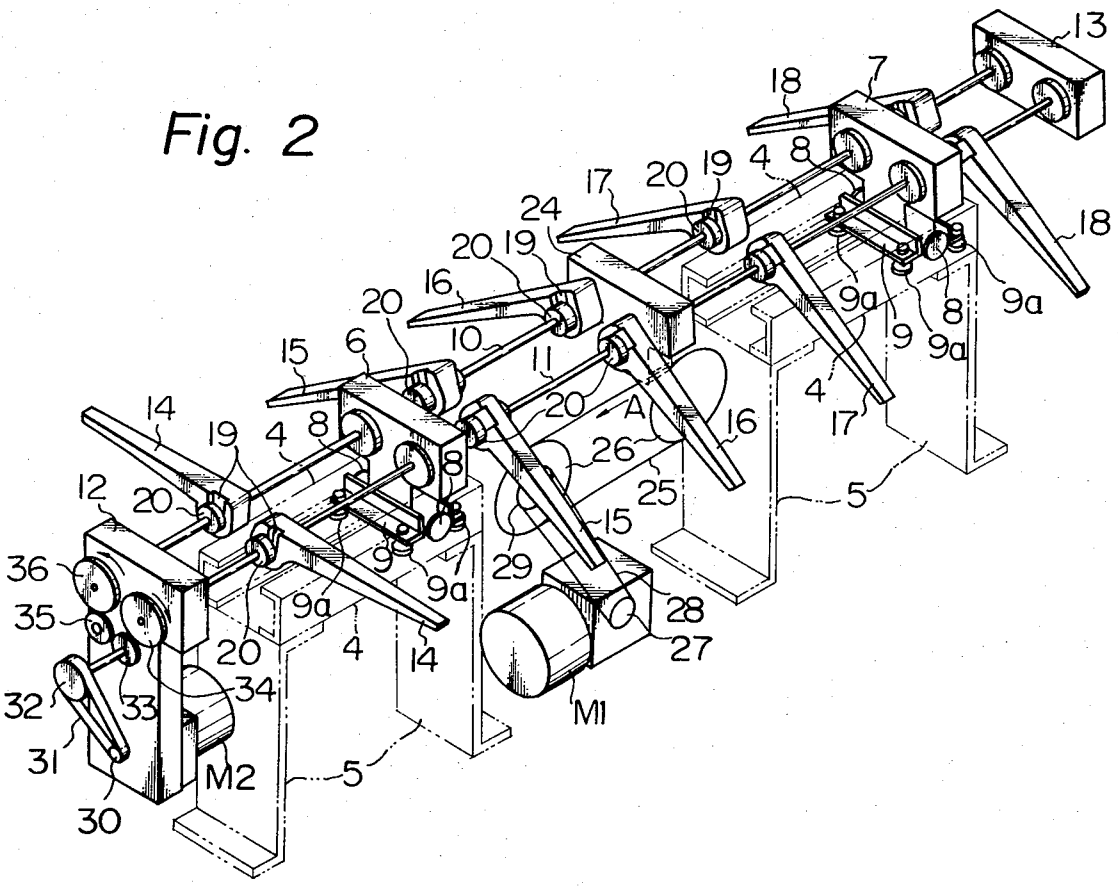
FIG. 2 is a perspective view of the apparatus for automatically changing the cans of FIG. 1.

Roller guide rails 4 have a C shaped cross section as illustrated in FIG. 3 and are supported on the upper surfaces of support brackets 5 which are made of plate members and which are projected from the guide plate 1 so that the roller guide rails 4 are parallel to each other. As illustrated in FIG. 3, support blocks 6 and 7 are formed in a T shape and rotatable support rollers 8 which are rotatable in vertical planes along inner bottom surfaces 4*a* of the roller guide rail 4. The support blocks 6 and 7 further support brackets 9 by which four horizontal rollers 9*a* (see FIG. 2) are rotatably supported so that the rollers 9*a* rotate along inner side walls 4*b* of the roller guide rail 4. Referring to FIG. 2, traverse bars 10 and 11 are supported in parallel so that they are relatively immovable in an axial direction but are rotatable about the axes thereof. As illustrated in FIG. 2, connecting members 12 and 13 are secured to front and rear ends of the traverse bars 10 and 11, respectively, in such a manner that the rotation of the traverse bars 10 and 11 is permitted but relative axial movement of the traverse bars 10 and 11 is not permitted.

Figure 4:
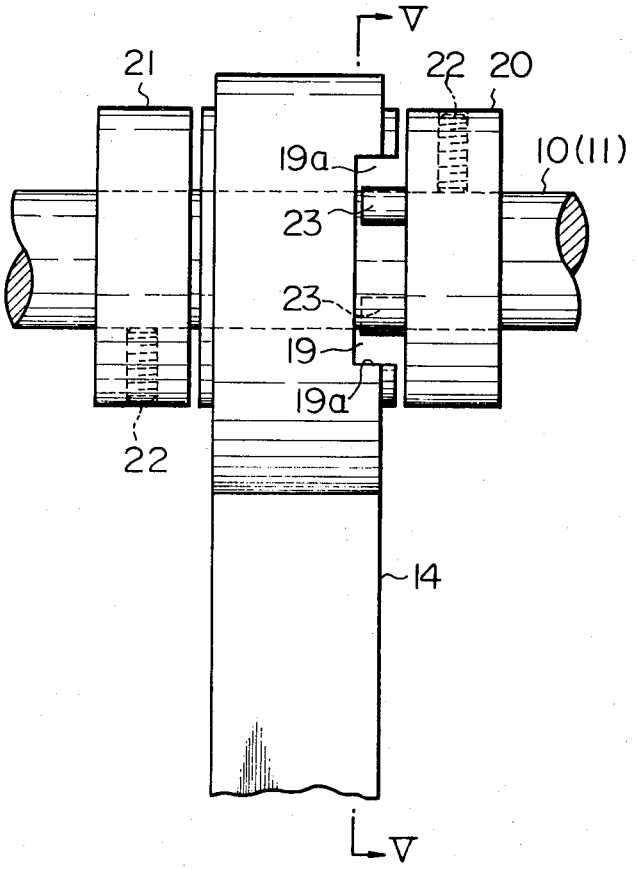
FIG. 4 is a side view of a part of a can transporting arm.
Figure 5:
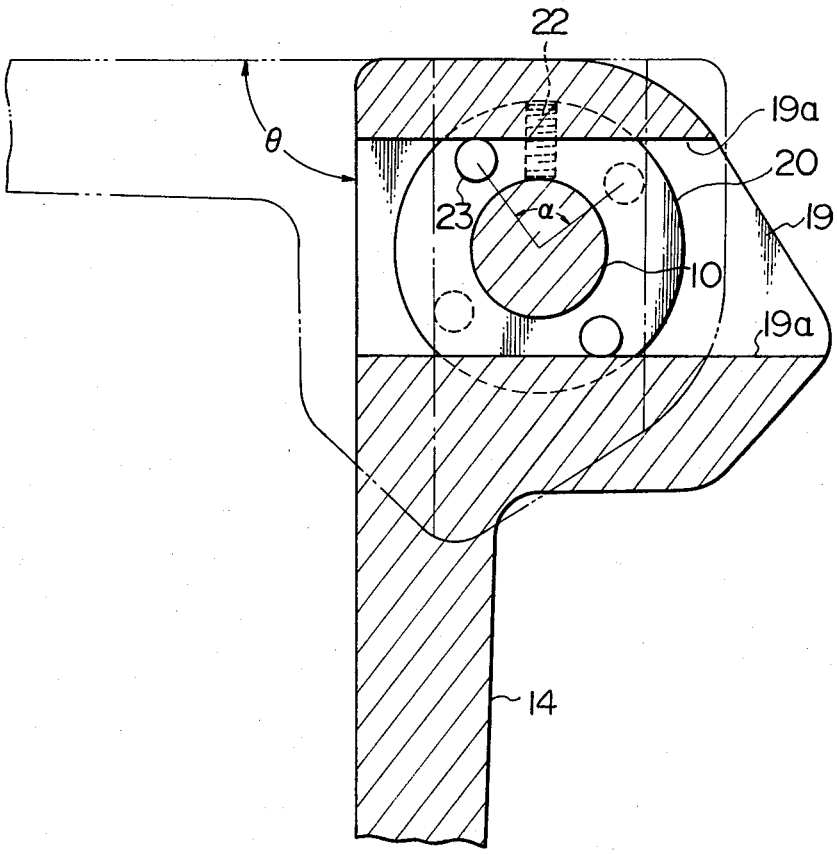
FIG. 5 is a cross sectional view taken along line V—V in FIG. 4 which illustrates the locational relationship between a recessed portion formed on the can transporting arm of FIG. 4 for pushing a full can and projections formed on a stop ring.
Figure 6:
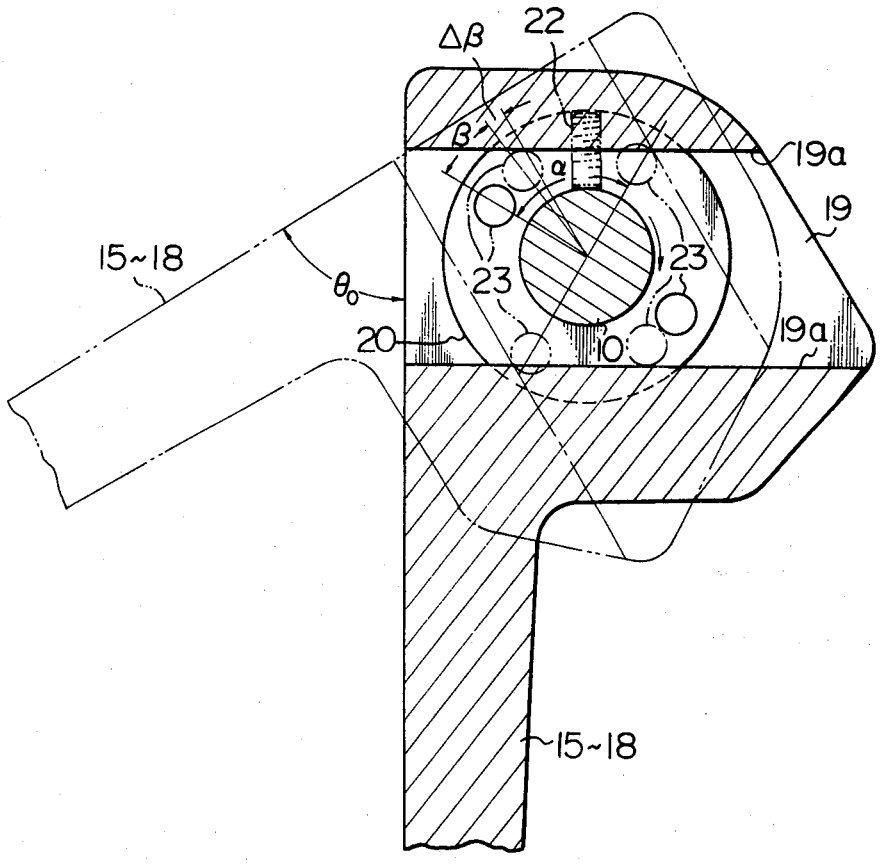
FIG. 6 is a cross sectional view of a part of another can transporting arm which is similar to FIG. 5 and which illustrates the locational relationship between a recessed portion formed on a can transporting arm for pushing an empty can and projections formed on a stop ring.

Referring to FIG. 2, can transporting arms 14, 15, 16, 17 and 18 are rotatably supported on the traverse bars 10 and 11, and the distances between two adjacent can transporting arms 14 through 18 are the same. In FIGS. 4 through 6, the front sides of the base portions of the can transporting arms 14 through 18 have recessed portions 19 which extend in directions vertical to the corresponding can transporting arms 14 through 18. In FIG. 4, a pair of stop rings 20 and 21 are rotatably engaged with the traverse bar 10 or 11 and are secured to the traverse bar 10 or 11 at the sides of the can transporting arm 14, 15, 16, 17 or 18 by means of set bolts 22. The inner surface of the stop ring 20 which faces the recessed portion 19 formed on the can transporting arm 14, 15, 16, 17 or 18 has two projections 23 which are diametrically located as illustrated in FIGS. 5 and 6 and which engage with the recessed portion 19 as illustrated in FIG. 5.

In the above-described embodiment, some of the positions of the stop rings 20 are set by means of the set bolts 22 so that, when the can transporting arm 14 illustrated at the left in FIG. 1 is in a vertically downward position as illustrated by a solid line in FIG. 5, the projections 23 formed on the stop rings 20 become abutted with upper and lower side walls 19*a* of the recessed portion 19 as illustrated in FIG. 5. As a result, when the traverse bar 10 is rotated clockwise by an angle $\alpha$, which is usually 90 degrees, the projections 23 press against the side walls 19*a* of the recessed portion 19, and accordingly, the can transporting arm 14 is swung clockwise (in FIG. 5) by an angle $\theta$ which is equal to $\alpha$, i.e., usually 90 degrees, and is brought to a horizontal position which is illustrated by a two-dot and dash line in FIG. 5.

Furthermore, in the above-described embodiment of the present invention, the remaining stop rings 20 are secured to the traverse bar 10 or 11 so that, when the can transporting arms 15 through 18 illustrated in FIG. 1 are positioned vertically downward, as illustrated by a solid line in FIG. 6, the projections 23 of the stop rings 20 are located at positions which are distant from the side walls 19*a* of the recessed portion 19 by an angle $\beta+\Delta\beta$, which is equal to 30 degrees in this embodiment. An angle $\beta$ denotes the deviation of the common center of circles illustrated by a solid line and a two-dot and dash line, and an angle $\Delta\beta$ denotes a change of the abutting position due to a rotation of the stop rings 20. As a result of the above-explained construction, when the traverse bar 10 is rotated clockwise by the angle $\alpha$, which is usually 90 degrees as described above, in FIG. 6, the projections 23 become abutted with the side walls 19*a* of the recessed portions 19 after they are swung by an angle which is equal to $\beta+\Delta\beta$. Accordingly, the can transporting arms 15 through 18 are swung by an angle $\theta_0$ to a position illustrated by a two-dot and dash line in FIG. 6, wherein $\theta_0$ is obtained as follows.

$$\begin{aligned}\theta_0 &= \alpha - (\beta + \Delta\beta)\\ &= 90^\circ - (30^\circ)\\ &= 60^\circ\end{aligned}$$

A driving mechanism for horizontally reciprocating the traverse bars 10 and 11 and the can transporting arms 14 through 18 will now be explained with reference to FIG. 2. A movable block 24 is engaged with the center of the traverse bars 10 and 11 in such a manner that the rotation of the traverse bars 10 and 11 about the axes thereof is permitted but the relative axial movement of the traverse bars 10 and 11 is not permitted and that a thrust load acting on the traverse bars 10 and 11 is received by the movable block 24. A pair of sprocket wheels 26 are supported by the support brackets 5 via bearings (not shown), and an endless transmitting member, such as an endless chain 25 or an endless toothed belt, is wrapped around the sprocket wheels 26. A chain link 25*a* of the endless chain 25 is connected to the lower portion of the movable block 24 is illustrated in FIG. 1. A first reversible motor $M_1$ for horizontally reciprocating the traverse bars 10 and 11 is disposed on the guide plate 1, and the rotational movement of the first reversible motor $M_1$ is transmitted to one of the sprocket wheels 26 through a sprocket wheel 27 connected to the shaft of the reversible motor $M_1$, another endless transmitting member, such as an endless chain 28, and a sprocket wheel 29 disposed coaxially with one of the sprocket wheels 26. A second reversible motor $M_2$ for rotating the can transporting arms 14 through 18 is fixed on the lower rear side of the connecting member 12, and the rotational movement of the reversible motor $M_2$ is transmitted to the traverse bar 11, through a pulley 30 connected to a spindle of the second reversible motor $M_2$, a belt 31 wrapped around the pully 30, an intermediate pulley 32, an intermediate gear 33 disposed coaxially with the intermediate pulley 32, and a gear 34 connected to the traverse bar 11 and meshing with the intermediate gear 33. The rotational movement of the intermediate gear 33 is also transmitted to the traverse bar 10 through an idler gear 35 meshing with the intermediate gear 33, and a gear 36 connected to the traverse bar 10 and meshing with the idler gear 35.

In FIG. 3, stoppers 37 are formed on the side walls of the support bracket 5 and serve to restrict the position of the can transporting arms 14 through 18 connected to the parallel traverse bars 10 and 11 when the arms 14 through 18 are located at the vertical stand-by positions.

Figure 7:
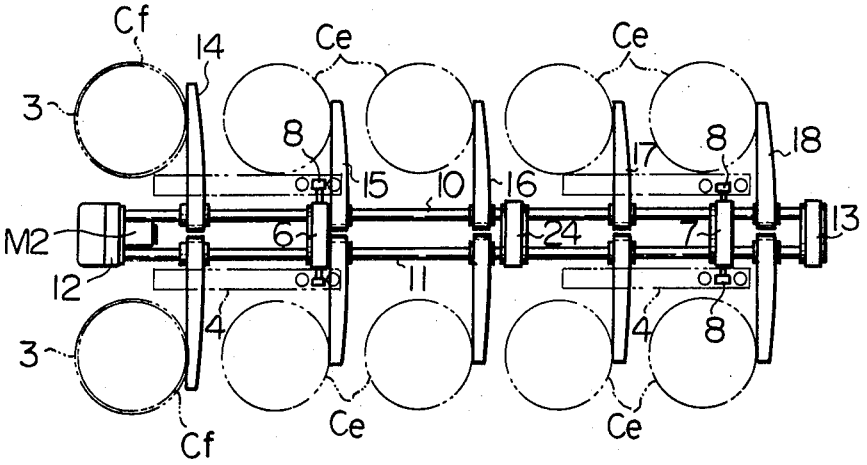
FIG. 7 is a plan view of the apparatus in FIG. 1 which illustrates a condition just before the apparatus for changing cans is operated.

The operation of the apparatus for automatically changing cans which has been constructed in the foregoing manner will now be explained. In FIGS. 1, 2 and 7, a condition is illustrated wherein the traverse bars 10 and 11 are moved backward, i.e., to the right, and the can transporting arms 14 are rotated by means of the projections 23 (FIG. 4) formed on the stop rings 20 to horizontal positions (see FIG. 2) and the can transporting arms 15 through 18 are maintained at positions inclining from a horizontal plane by the angle $\theta_0$ (FIG. 6) of 60 degrees by means of the projections 23, and in addition, as illustrated in FIG. 7, the full cans $C_f$ are arranged on the turn tables 3 (FIG. 1), the upper surfaces of which are aligned with the guide plate 1 and empty cans $C_e$ are arranged on the guide plate 1 located at the right of the turn tables 3, so that the cans $C_f$ and $C_e$ correspond to the can transporting arms 14 through 18. In this condition, when a predetermined amount of fiber bundles, such as slivers, are collected within the cans $C_f$ located on the turn tables 3, an auto counter (not shown) which is fixed to the spinning head H (FIG. 1) and which has a conventionally well known construction transmits a full signal. When the full signal is transmitted, a control circuit which is not illustrated but which is well known in the field to which the present invention relates operates so that the first reversible motor $M_1$ (see FIGS. 1 and 2) is rotated in a normal direction, and accordingly, because of the normal rotation of the first reversible motor $M_1$, the chain 25 is rotated in a direction illustrated by an arrow A in FIGS. 1 and 2. Then the movable block 24, the traverse bars 10 and 11, the support blocks 6 and 7, the connecting members 12 and 13, and the can transporting arms 14 through 18, are moved forward as a whole, i.e., to the left in FIGS. 1, 2 and 7, along the roller guide rails 4. As a result, the full cans $C_f$ which were located on the turn tables 3 (FIG. 1) are pushed forward, i.e., to the left in FIGS. 1, 2 and 7, by means of the horizontally located can transporting arms 14 and are discharged from the turn tables 3. The empty cans $C_e$ located next to the full cans $C_f$ are transported onto the turn tables 3 by means of the can transporting arms 15, and the subsequent empty cans $C_e$ are also moved forward, i.e., to the left in FIGS. 1, 2 and 7, by a distance equal to the distance between two adjacent cans by means of the can transporting arms 16 through 18.

Figure 8:
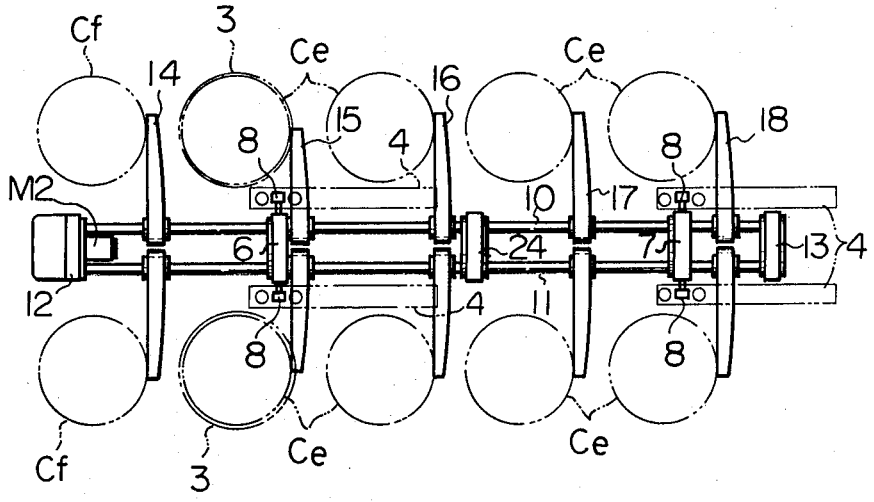
FIG. 8 is a plan view of the apparatus in FIG. 1 which illustrates a condition just after the apparatus for changing cans has been operated.

When the can transporting arms 14 through 18 are moved to the positions illustrated in FIG. 8 and the changing of the cans $C_f$ and $C_e$ is completed, the first reversible motor $M_1$ (FIGS. 1 and 2) is stopped so that the forward movement of the traverse bars 10 and 11 and the can transporting arms 14 through 18 is stopped. Just after the first reversible motor $M_1$ is stopped, the second reversible motor $M_2$ is started to rotate in a normal direction, and due to the rotational movement of the second reversible motor $M_2$, the traverse bar 11 is rotated clockwise in FIG. 3 via the pulley 30 (FIG. 2), the belt 31, the pulley 32, the gears 33 and 34 and the can transporting arms 14 through 18 connected to the traverse bar 11 are also swung as indicated by an arrow B in FIG. 3. The rotational movement of the gear 33 (FIG. 2) is transmitted to the traverse bar 10 via the gears 35 and 36, and accordingly, the traverse bar 10 and the can transporting arms 14 through 18 connected thereto are swung as indicated by an arrow C in FIG. 3. When the traverse bars 10 and 11 are rotated by the angle $\alpha$, which is usually 90 degree, the projections 23 formed on the stop rings 20 are also rotated by the angle $\alpha$, and accordingly, the can transporting arms 14 are rotated by the angle $\theta$ (90 degrees) from their horizontally located operating positions, one of which is illustrated by the two-dot and dash line in FIG. 5, to the stand-by positions, one of which is illustrated by a solid line in FIG. 5, due to the force of gravity on the can transporting arms 14. When the traverse bars 10 and 11 are rotated by the angle $\alpha$ (90 degrees), the can transporting arms 15 through 18 are rotated by the angle $\theta_0$ (60 degrees) from the inclined operating positions, one of which is illustrated by the two-dot and dash line in FIG. 6, to the vertical stand-by positions, one of which is illustrated by the solid line in FIG. 6 and the movement of the can transporting arms 15 through 18 is restricted by the stoppers 37 (FIG. 3). However, the projections 23 formed on the stop rings 20 illustrated in FIG. 6 are further rotated by the angle $\beta+\Delta\beta$, which is equal to 30 degrees, so that the projections 23 are distanced from the side walls 19*a* of the recessed portions 19 and positioned as illustrated by the solid lines in FIG. 6.

After the can transporting arms 14 through 18 are moved to the vertically downward stand-by positions where they do not interfere with the empty cans $C_e$ (FIGS. 1, 7 and 8), the second reversible motor $M_2$ (FIGS. 1 and 2) is stopped so that the rotational movement of the traverse bars 10 and 11 is stopped. Thereafter, the first reversible motor $M_1$ is driven again in a reverse direction, so that the traverse bars 10 and 11 and the can transporting arms 14 through 18 are moved backward, i.e., to the right in FIGS. 1, 2 and 8, by a distance equal to the distance between two adjacent empty cans $C_e$, and then the first reversible motor $M_1$ is stopped.

After the backward movement of the can transporting arms 14 through 18 are completed, the second reversible motor $M_2$ is rotated in a reverse direction. Accordingly, the can transporting arms 14 through 18 are returned to their original horizontal positions illustrated in FIGS. 1, 2 and 7 in a manner opposite to the foregoing rotational movement to the vertically downward stand-by positions. Thus one cycle for changing cans is completed.

The above-explained embodiment of the present invention is constructed in such a manner that the can transporting arms 14 through 18 are rotatably supported on the traverse bars 10 and 11, that the projections 23 formed on the stop rings 20 are engaged with the recessed portions 19 formed at the base portions of the can transporting arms 14 through 18, and that the distance between the projections 23 and the side walls 19*a* of the recessed portions 19 can be adjusted at a desired value by securing the stop rings 20 to the traverse bars 10 and 11 by means of set bolts 22. Accordingly, the rotational angles $\theta$ and $\theta_0$ of the can transporting arms 14 through 18, which angles are defined as angles formed by the can transporting arms 14 through 18 when they are positioned in the vertically downward stand-by positions and the can transporting arms 14 through 18 located at the operating positions when the traverse bars are rotated by an angle can voluntarily be adjusted. As a result, it is possible to adjust the abutting heights of the can transporting arms 14 and 15 through 18 at any desired operating positions in accordance with whether the cans are full cans $C_f$ or empty cans $C_e$, so that both the full cans $C_f$ and the empty cans $C_e$ can stably be transported.

It is possible to realize the present invention in other embodiments as follows.

Figure 9:
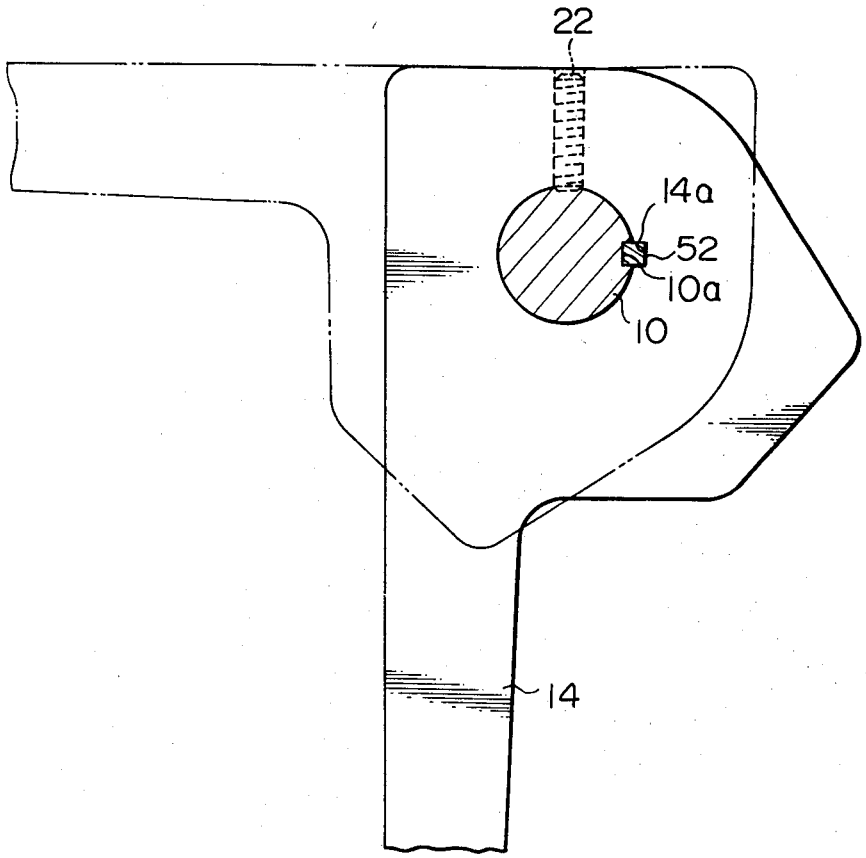
FIG. 9 is a partial elevational view of a part of still another can transporting arm of another embodiment according to the present invention.
Figure 10:
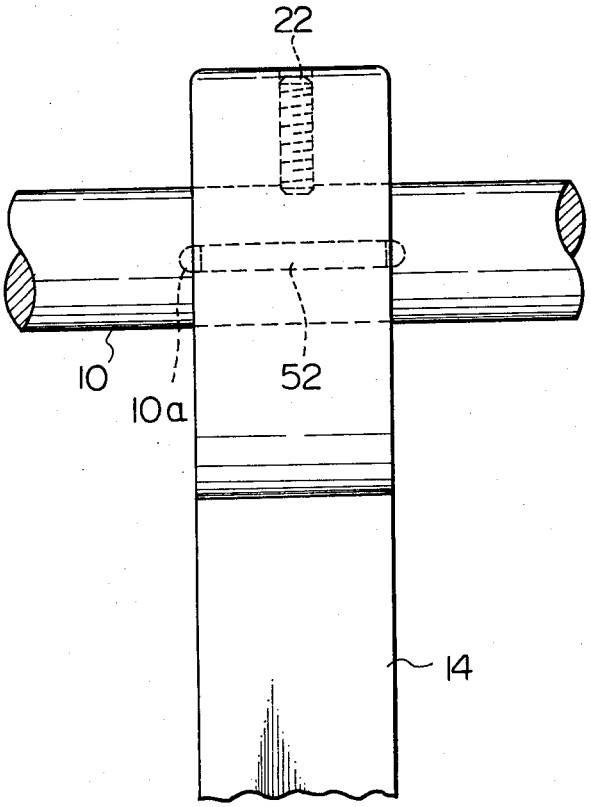
FIG. 10 is a side view of FIG. 9.

A. Either the can transporting arms 14 for pushing the full cans $C_f$ or the can transporting arms 15 through 18 for pushing the empty cans $C_e$ are fixedly secured to the traverse bars 10 and 11. It is preferable that the can transporting arms 14 are directly secured to the traverse bars 10 and 11 by means of a securing means, such as set bolts 22 threaded to the threaded holes of the arms 14 or keys 52 inserted into key ways 14*a* and 10*a* formed on the can transporting arms 14 and the traverse bars 10 as illustrated in FIGS. 9 and 10. (Only one traverse bar 10 and only one can transporting arm 14 are illustrated in FIGS. 9 and 10.) In this embodiment, since the can transporting arms 14 or 15 through 18 which are directly secured to the traverse bars 10 and 11 are swung together with the guide bars 10 and 11, the operational positions of the can transporting arms 14 or 15 through 18 can be adjusted by changing the rotational angle $\alpha$ of the traverse bars 10 and 11.

B. In the previously explained embodiments, the can transporting arms 14 through 18 located at the stand-by positions are in a vertically downward position. Instead, the can transporting arms 14 through 18 may be projected vertically upward when they are located at the stand-by positions.

Figure 11:
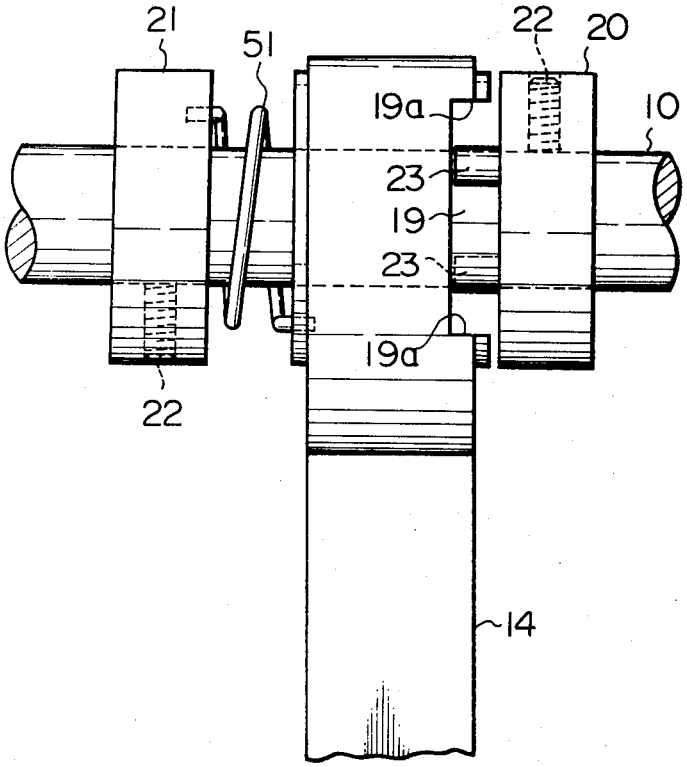
FIG. 11 is a side view of a part of a can transporting arm of a further embodiment of the present invention.

C. In the embodiment explained with reference to FIGS. 1 through 8, the can transporting arms 14 through 18 are returned from their operational positions to their stand-by positions by means of the force of gravity thereon, however, it is also possible to install a means which positively moves the can transporting arms 14 through 18 to their stand-by positions. An example of the positively moving means is illustrated in FIG. 11 wherein a torsion coil spring 51 is disposed between the stop ring 21 and the side of the can transporting arm 14 which side faces the stop ring 21, so that the can transporting arm 14 is normally urged towards its stand-by position.

D. In the embodiment explained with reference to FIGS. 1 through 8, the can transporting arms 14 through 18 are rotated by means of the second reversible motor $M_2$. It is also possible that a specially designed cam mechanism is utilized so that the cam mechanism cooperates with the traverse bars and so that the can transporting arms 14 through 18 are rotated by means of said cam mechanism while they are reciprocated. An embodiment of this type will now be explained with reference to FIGS. 12 through 15. Traverse bars 10 and 11 have a construction similar to that of the traverse bars 10 and 11 explained with reference to FIGS. 1 through 8 and are horizontally reciprocated by means of a single driving source, such as the first reversible motor $M_1$ (FIG. 1) or a pneumatic cylinder (not shown). The traverse bars 10 and 11 have can transporting arms 14 and 15 rotatably mounted thereon. Support blocks 6 and 7 and stop rings 40 engaged with the traverse bars 10 and 11 are so constructed that they restrict the axial relative movement of the can transporting arms 14 and 15. Stoppers 41 which become abutted with the upper surfaces of the base portions of the can transporting arms 14 and 15 are secured to the inner sides of the support blocks 6 and 7 by means of set bolts 42 in such a manner that the stoppers 41 are vertically adjustable and that the operating heights of the can transporting arms 14 and 15 can be adjusted. Thus the can transporting arm 14 for pushing the full can $C_f$ are adjusted at a high level, and the can transporting arms 15 for pushing the empty can $C_e$ adjusted at a low level. Cam 43 for actuating the can transporting arms 14 and 15 has recessed portions 43*a* equidistantly formed thereon, and the cam 43 is disposed on the guide plane 1 in parallel with the traverse bars 10 and 11. Levers 45 for operating the can transporting arms 14 and 15 have an L-shaped cross section and are rotatably supported by means of shafts 44 on the stop rings 40 which are engaged with the traverse bars 10 and 11. Lower ends of the levers 45 have rollers 46 rotatably supported thereon, which rollers 46 are in contact with the cam surface of the cam 43. The upper ends of the levers 45 have rollers 47 rotatably supported thereon, which rollers 47 are in contact with the upper surfaces of the base portions of the can transporting arms 14 and 15.

Figure 12:
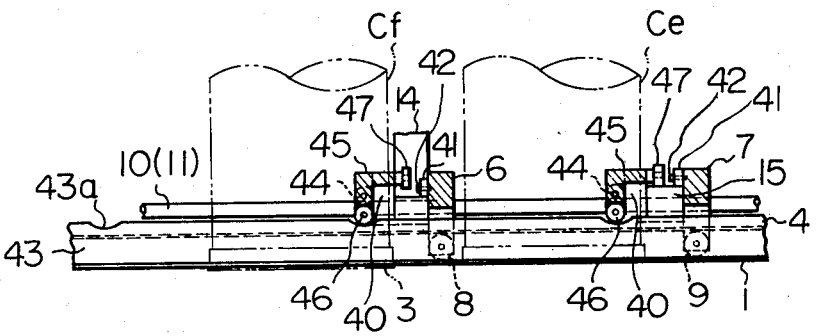
FIGS. 12 through 15 are side views of still another embodiment which sequentially illustrate the operation of said embodiment according to the present invention.
Figure 13:
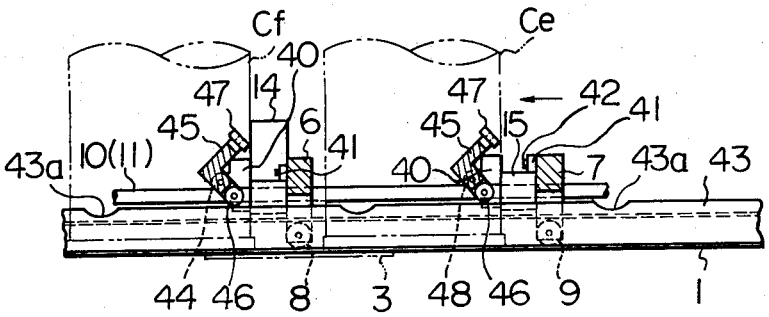
Figure 14:
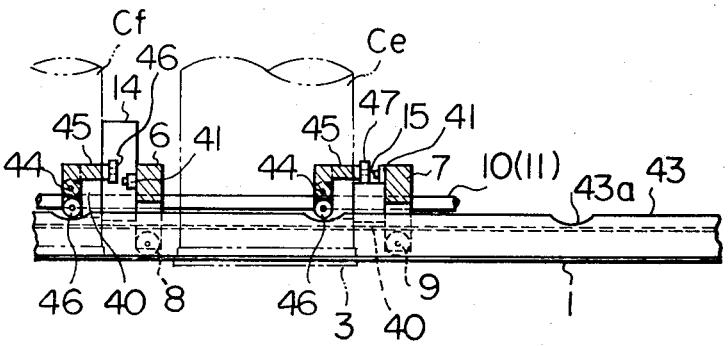
Figure 15:
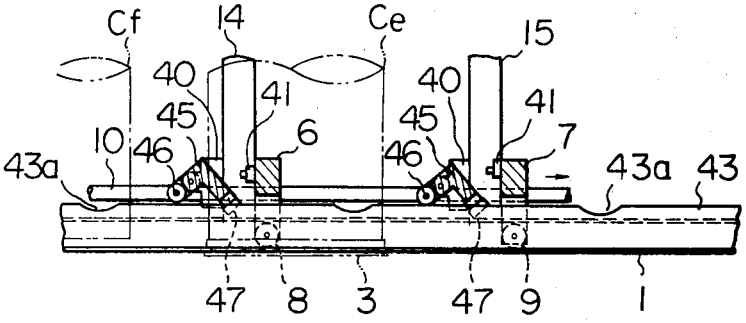

The apparatus for changing cans, illustrated in FIGS. 12 through 15, operates as follows. When the traverse bars 10 and 11 are moved forward, i.e., to the left in FIGS. 12 through 15, from the retracted position illustrated in FIG. 12, the cans $C_f$ and $C_e$ are transported by means of the can transporting arms 14 and 15 as illustrated in FIG. 13. During this movement, the rollers 46 supported on the levers 45 for operating the can transporting arms 14 and 16 are released from the recessed portions 43*a* formed on the cam 43 for actuating the can transporting arms 14 and 15, and the levers 45 are rotated counterclockwise (in FIGS. 12 through 15) about the shaft 44. Accordingly, as illustrated in FIG. 14, the full cans $C_f$ (only one is illustrated in FIGS. 12 through 15) are discharged from the turn tables 3 (only one is illustrated in FIGS. 12 through 15) which have a construction similar to that of the turn tables 3 illustrated in FIG. 1, and the empty cans $C_e$ (only one is illustrated in FIGS. 12 through 15) located next to the full cans $C_f$ are transported onto the turn tables 3. Then, since the rollers 46 supported on the levers 45 for operating the can transporting arms 14 and 15 engage with other recessed portions 43*a* formed on the cam 43 for actuating the can transporting arms 14 and 15, the base portions of the levers 45 become positioned vertically. When the traverse bars 10 and 11 are moved backward, i.e., to the right, from the position illustrated in FIG. 14, the rollers 46 supported on the levers 45 are released from the recessed portions 43*a* formed on the cam 43, and the levers 45 are rotated counterclockwise in FIGS. 12 through 15 about the shaft 44 so that the rollers 47 press the upper surfaces of the base portions of the can transporting arms 14 and 15 downward. As a result, the can transporting arms 14 and 15 are turned upward so that they do not interfere with the empty cans $C_e$. When the traverse bars 10 and 11 are further moved backward, i.e., to the right in FIGS. 12 through 15 and the rollers 46 engage with the recessed portions 43*a* located rearward, the levers 45 for operating the can transporting arms 14 and 15 are rotated counterclockwise in FIG. 12, and as a result, the can transporting arms 14 and 15 are returned to their original positions as illustrated in FIG. 12.

We claim:

1. An apparatus for automatically changing cans of a spinning machine comprising:

a movable support frame which can be reciprocated along a transporting direction of the cans; and a plurality of can transporting arms which are substantially equidistantly arranged on said support frame and which can alternately be located at operating positions where said arms transport said cans and stand-by positions where said arms do not interfere with said cans, whereby, when said movable support frame is moved forward, said can transporting arms are maintained at said operating positions so as to transport said cans, and then, after said can transporting arms are returned to said stand-by positions from said operating positions, said supprt frame is moved backward, characterized in that, said apparatus further comprises an arm height adjusting member by which different heights of the can transporting arms in said operating positions where said arms abut the cans are adjustable while said can transporting arms in said stand-by positions are almost at the same level as each other.

2. An apparatus for automatically changing cans of a spinning machine according to claim 1, wherein said movable support frame comprises:

a plurality of movable support blocks which can be reciprocated along the transporting direction of the cans; and a traverse bar which extends along the traversing direction of the cans and which is rotatable relative to said support blocks but is axially immovable relative to said support blocks, and wherein said can transporting arms are substantially equidistantly supported on said traverse bar in such a manner that they are rotatable relative to said traverse bar but are axially immovably relative to said traverse bar.

3. An apparatus for automatically changing cans of a spinning machine according to claim 2, wherein said arm height adjusting member comprises:

recessed portions formed at a side of the base portions of said transporting arms;

stop rings which are fixed on said traverse bar so that the rotational positions thereof can be adjusted and so that the relative axial movement of said transporting arms is prevented; and projections formed on the inner sides of said stop rings and inserted into said recessed portions so that the distances between said projections and the sides of said recessed portions can be changed.

4. An apparatus for automatically changing cans of a spinning machine according to claim 2, which further comprises a means for rotating said traverse bar, which means is mounted on a connecting member which is supported rotatably but axially immovably on one end of said traverse bar.

5. An apparatus for automatically changing cans of a spinning machine according to claim 2, wherein a part of said transporting arms are fixedly secured to said traverse bar and the remaining said transporting arms are secured to said traverse bar by means of a swinging angle adjusting member which comprises:

recessed portions formed at a side of the base portions of said remaining transporting arms;

stop rings fixed on said traverse bar in such a manner that rotational position thereof can be adjusted and that the relative movement of said remaining transporting arms is prevented; and projections formed on the inner sides of said stop rings and inserted into said recessed portions in such a manner that the distances between said projections and the sides of said recessed portions can be adjusted.

6. An apparatus for automatically changing cans of a spinning machine according to claim 3 or 5, which further includes an urging member between the stop rings and said transporting arms so that said transporting arms are normally urged toward said stand-by positions by means of said urging member.

7. An apparatus for automatically changing cans of a spinning machine according to claim 1, wherein the rotational movement of said transporting arms is controlled by means of a cam mechanism in accordance with the reciprocating movement of said movable support frame.

8. An apparatus for automatically changing cans of a spinning machine according to claim 7, wherein said cam mechanism has a plurality of recessed portions formed thereon and is disposed in parallel with said movable support frame, levers which have one end engaged with said cam mechanism and another end of which actuates said transporting arms, said levers being swingably supported on said movable support frame, and stoppers for adjusting the heights of said transporting arms when they are at said operating positions are adjustably disposed on said movable support frame.

* * * * *